United States Patent [19]

Tarumoto et al.

[11] Patent Number: 4,729,729

[45] Date of Patent: Mar. 8, 1988

[54] ROTOR HOUSING FOR ROTARY PISTON ENGINES

[75] Inventors: Kouji Tarumoto; Satoshi Nanba, both of Hiroshima, Japan

[73] Assignee: Mazda Motor Corporation, Hiroshima, Japan

[21] Appl. No.: 886,380

[22] Filed: Jul. 17, 1986

[30] Foreign Application Priority Data

Jul. 26, 1985 [JP] Japan ..... 60-166391

[51] Int. Cl.[4] ..... F01C 1/22; F01C 21/00; B32B 15/00; C25D 5/00

[52] U.S. Cl. ..... 418/178; 418/179; 428/613; 428/666

[58] Field of Search ..... 418/61 A, 178, 179; 123/668; 92/171; 428/613, 666, 667; 204/24, 26, 29

[56] References Cited

U.S. PATENT DOCUMENTS

Re. 29,806 10/1978 Iida et al. ..... 418/178

FOREIGN PATENT DOCUMENTS 41-18604 10/1966 Japan .

54-130714 10/1979 Japan ..... 418/178

*Primary Examiner*—John J. Vrablik

*Attorney, Agent, or Firm*—Fleit, Jacobson, Cohn & Price

[57] ABSTRACT

There is disclosed a rotor housing for a rotary piston engine which is designed particularly for high output power wherein the rotor housing inner wall surface is required to possess heat and wear resistant properties, improved affinity to lubricant oil, resistance to uneven wear which may cause chatter marks and scratches, oil retaining property, and less harmfulness to the apex seal. The rotor housing is formed at the inner wall surface with a porous Cr-Mo plating containing 0.50 to 0.90% in weight of Mo.

5 Claims, 9 Drawing Figures

( X 200)

( X 200)

ROTOR HOUSING FOR ROTARY PISTON ENGINES

BACKGROUND OF THE INVENTION

1. Field of the Invention

The present invention relates to rotary piston engines, and more particularly to rotor housings for rotary piston engines. More specifically, the present invention pertains to rotor housings having improved inner wall surfaces.

2. Description of the Prior Art

In rotary piston engines, the inner wall surface of the rotor housing and the apex seals on the rotor which slidably moves on the inner wall surface of the rotor housing are subjected to mechanical loads due to vibrations, impact loads and frictions, as well as thermal loads due to the combustion in the engine. Usually, the inner wall surface of the rotor housing is applied with hard chromium plating layer but, due to the aforementioned mechanical loads and the thermal loads to which the rotor housing is subjected, there are very often produced in the chromium plating layer on the rotor housing uneven wear such as chatter marks and scratches.

In order to avoid the problems, proposals have been made to appropriately determine the hardness of the apex seal with respect to the hardness of the chromium plating layer on the rotor housing, or to provide the chromium plating layer with porous structure of for example pin-point type or channel-type so that lubricant oil can be retained in the pores. Such solutions have already been known in the art of reciprocating piston engines. For example, Japanese patent publication No. 41-18604 teaches to provide a cylinder liner with a plating layer of a corrosion resistant Cr-Mo alloy containing 1 to 5% of Mo, the layer being covered a porous chromium plating layer which is superior to the Cr-Mo alloy layer in respect of machining property and the intimacy to the piston ring. The proposal is based on the recognition of the fact that the Cr-Mo alloy has a high hardness and therefore shows a superior wear resistant property but it does not have a good machining property, and is aimed to provide a satisfactory machining property by the porous chromium layer. It should however be noted that the proposed structure has problems in that the chromium plating layer is destroyed after initial operations of the engine so that there will be a loss in the lubrication property.

Further problems are encountered in recent supercharged high power rotary piston engines in that the lubricating oil film on the inner wall of the rotor housing is broken due to a high temperature in the working chambers and the high combustion pressure. Therefore, the inner wall surfaces of these engines are subjected to very serious conditions so that conventional technologies are not sufficient to meet the requirements in these high power engines.

In order to solve the problems, the quantity of the lubricating oil supplied to the inner wall surface of the rotor housing may be increased to thereby provide a satisfactory lubrication. It should however be noted that the solution is not recommendable because there will be an increase in the oil consumption and also an adverse effect on the pollutant emissions in the engine exhaust gas. It is therefore highly desirable to provide an effective means to solve the aforementioned problems.

SUMMARY OF THE INVENTION

It is therefore an object of the present invention to provide a rotor housing for a rotary piston engine which can withstand a high engine temperature.

Another object of the present invention is to provide a rotor housing having an inner wall surface which possesses high heat-resistant and wear-resistant properties as well as good lubricating and sliding properties.

A further object of the present invention is to provide a rotor housing having an inner wall surface which shows minimum decrease in the hardness even under a high temperature.

Still further object of the present invention is to provide a rotor housing which is easy to machine but has low oil consumption and can maintain its lubricating property for a long period of time.

According to the present invention, the above and other objects can be accomplished by a rotor housing for a rotary piston engine, including an inner wall surface of trochoidal configuration provided with a porous plating layer of a Cr-Mo alloy containing 0.50 to 0.90% in weight of Mo. The Cr-Mo alloy plating layer shows superior property in respect of heat resistance, lubricant maintaining characteristics and frictional coefficient as compared with the Cr plating layer. The Mo content in the plating layer has a tendency to make honing treatment difficult. However, as far as the Mo content is lower than 0.90% in weight, the tendency is not significant so that the machining property is not adversely affected. Further, a Mo content greater than 0.90% in weight causes a significant increase in the oil consumption. A Mo content less than 0.50% in weight does not show any noticeable improvement over the Cr plating in preventing chatter marks and scratches.

The above and other objects and features of the present invention will become apparent from the following description of preferred embodiments taking reference to the accompanying drawings.

DESCRIPTION OF THE PREFERRED EMBODIMENT

Figure 2:
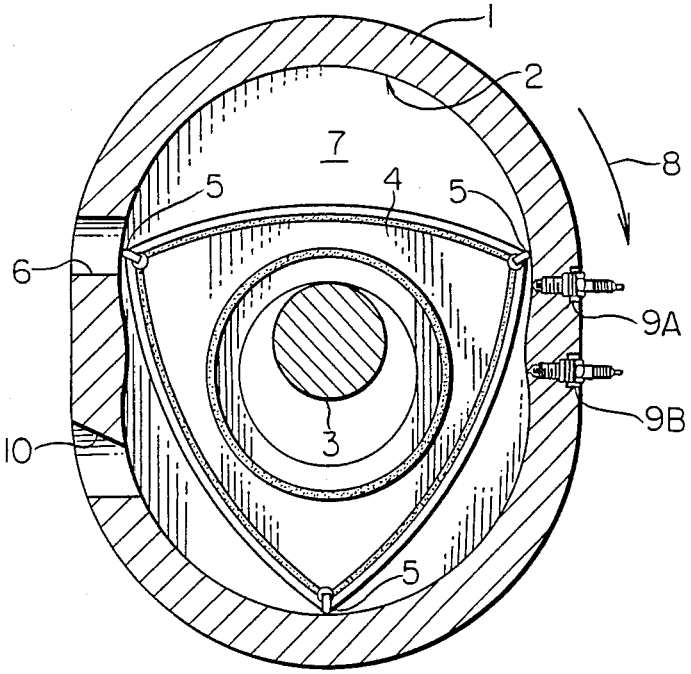
FIG. 2 is a sectional view of a rotary piston engine having the rotor housing shown in FIG. 1.

Referring to the drawings, particularly to FIG. 2, there is shown a rotary piston engine including a rotor housing 1 having an inner wall 2 of a trochoidal configuration with which apex seals 5 on apex portions of a triangular rotor 4 are slidably engaged. As well known in the art, the rotor is carried by an eccentric shaft 3. In the illustrated embodiment, the rotor housing is formed with an intake port 6 and an exhaust port 10. Working chambers 7 are defined by the inner wall 2 of the rotor housing 1 and flanks of the rotor 4. The intake port 6 communicates with one of the working chambers 7 which is in the intake stroke. The exhaust port 10 communicates with another working chamber 7 which is in the exhaust stroke. Lubricant-containing fuel is introduced together with intake air through the intake port 6 into the working chamber 7 which is in the intake stroke. The intake air is compressed as the rotor rotates, and ignited by ignition plugs 9A and 9B which are mounted on the rotor housing 1. Combustion then takes place in the working chambers 7 and the expanded combustion gas functions to rotate the rotor 4 before it is discharged through the exhaust port 10.

Figure 1:
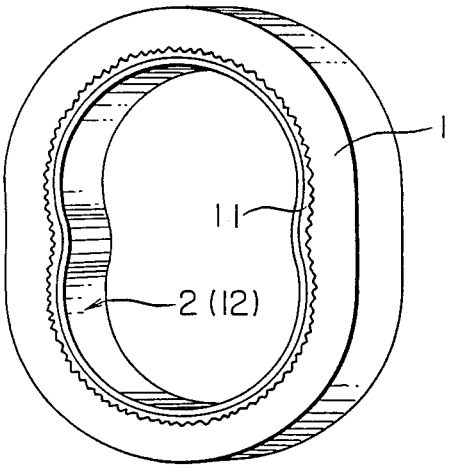
FIG. 1 is a perspective view of a rotary piston engine having a plating layer in accordance with one embodiment of the present invention.

As shown in FIG. 1, the rotor housing 1 is formed with a liner 11 which may be made of a sheet of a high tension steel and formed at the inner surface with the aforementioned trochoidal inner wall 2 and at the outer surface with serrations, with aluminum housing body being cast outside the liner 11. The liner 11 is formed at the inner wall 2 with a layer 12 of a porous plating of a Cr-Mo alloy. The inner wall surface 2 having the porous Cr-Mo alloy plating layer 12 is subjected to a sliding engagement with apex seals 5, so that the plating layer 12 is required to possess high heat-resistant and wear-resistant properties.

According to the present invention, the porous Cr-Mo plating layer 12 includes 0.50 to 0.90% in weight of Mo so that it can meet the requirements for the inner wall surface 2 of the rotor housing. In forming the plating layer 12, use may be made of a modified plating bath which may be prepared from a conventional Cr plating bath containing 250 g/l of chromic acid anhydride and 2.5 g/l of sulfic acid added with Mo in the form of molybdic acid or molybdate such as sodium molybdate or ammonium molybdate. According to a preferable example, 50 to 80 g/l of sodium molybdate ($Na_2Mo_4.2H_2O$) is added to the conventional plating solution. Recommendable process conditions are a bath temperture of 50 degrees centigrade and a current density of 50 A/cm$^2$. It should be noted that the precipitation of Mo in the plating bath depends on the Mo content in the bath and the addition of sodium molybdate of 50 to 80 g/l will yield to 0.50 to 0.90% in weight of Mo content in the plating layer. For providing the plating layer with a porous structure, a reverse electrolytic process is carried out. More specifically, after forming the plating layer, a reverse current of a current density of 50 A/cm$^2$ is applied for 2 minutes to perform the reverse electrolysis so as to form the plating layer with channel type cracks. Then, the plating layer surface is subjected to a honing treatment so that a pin-point type porous structure is retained. Thereafter, a further reverse current electrolysis is performed by applying a reverse current in a current density of 50 A/cm$^2$ for 1 minute to form channel-type cracks. With this process, there is formed a composite porous structure having pin-point type pores and channel type pores.

Figure 3:
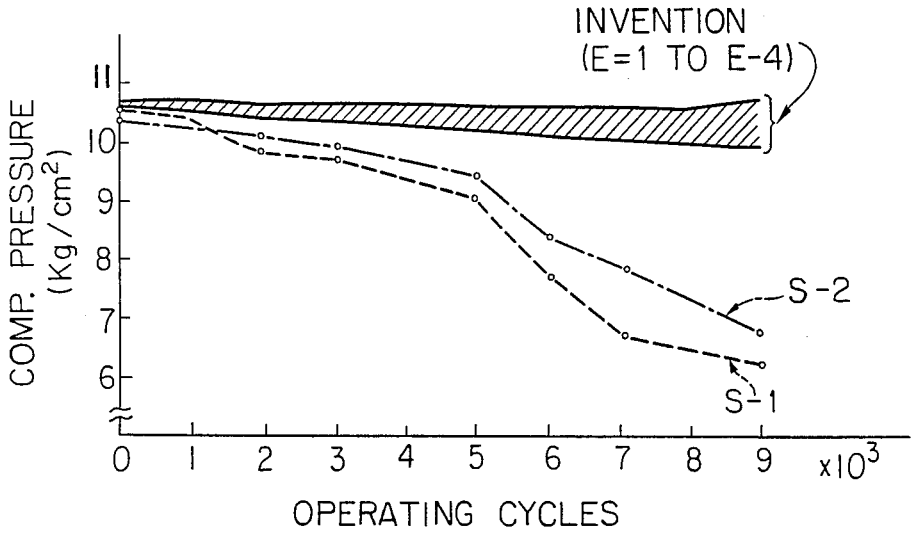
FIG. 3 is a diagram showing changes in the compression pressure.

Tests have been carried out with test pieces of rotor housing having Cr-Mo plating layers of different Mo contents. Apex seals used in the tests were made of a chilled alloy cast iron having the composition shown in Table II and of the hardness of Hv 700 to 910. The test pieces of the rotor housing are assembled in two-rotor type, 1300 cc, turbo-supercharged rotary piston engines which are then operated in 9000 cycles of operation, each cycle comprising operating the engine by fully opening the throttle valve from 3000 rpm to increase the engine speed to 7000 rpm under full load and maintaining at the speed for 40 seconds. In the test run, the engine cooling water temperature is adjusted in each operating cycle. After the test run, the engines are disassembled and the rotor housings are inspected for the existence of chatter marks, scratches, wears and seizure of the apex seals to the rotor housings. Results are shown in Table I and FIG. 3. Further, decrease in compression pressure is observed in each 1000 cycles and the results of the observations are shown in FIG. 3.

TABLE I

| | | C | | D | | | | | | |
|---|---|---|---|---|---|---|---|---|---|---|
| A | B | C-1 | C-2 | D-1 | D-2 | D-3 | D-4 | D-5 | D-6 | E |
| S-1 | 7 | 38 | | 2.5–3.0 | 2.0–3.0 | 210 | UNEVEN | YES | 0.27 | × |
| S-2 | 8 | 38 | | 2.5–3.0 | 2.5–3.0 | 195 | UNEVEN | YES | 0.27 | × |
| E-1 | 7 | 40 | | 4.0 | 4.0 | 80 | EVEN | NO | 0.26 | ○ |
| E-2 | 8 | 42 | | 4.0 | 4.5 | 85 | EVEN | NO | 0.27 | ○ |
| E-3 | 9 | 40 | | 4.5 | 4.0 | 80 | EVEN | NO | 0.27 | ○ |
| E-4 | 10 | 45 | | 4.0 | 4.5 | 75 | EVEN | NO | 0.26 | ○ |
| S-3 | 22 | 350 | × | 4.0 | 4.5 | 85 | EVEN | NO | 0.36 | × |
| S-4 | 25 | 380 | × | 4.5 | 4.5 | 95 | EVEN | NO | 0.37 | × |
| S-5 | 30 | 450 | × | 4.0 | 4.5 | 93 | EVEN | NO | 0.38 | × |

TABLE I-continued

| | | C | | D | | | | | | |
|---|---|---|---|---|---|---|---|---|---|---|
| A | B | C-1 | C-2 | D-1 | D-2 | D-3 | D-4 | D-5 | D-6 | E |
| S-6 | 45 | 520 | × | 4.0 | 4.5 | 85 | EVEN | NO | 0.38 | × |

NOTE: A; Type of the specimens wherein;
S-1 is a prior art with a porous Cr plating;
S-2 is a comparative test piece having a Cr—Mo plating containing 0.35% of Mo;
S-3 is a comparative test peice having a Cr—Mo plating containing 1.00% of Mo;
S-4 is a comparative test piece having a Cr—Mo plating containing 1.15% of Mo;
S-5 is a comparative test piece having a Cr—Mo plating containing 1.55% of Mo;
S-6 is a comparative test piece having a Cr—Mo plating containing 2.00% of Mo;
E-1 is an example of the invention having a Cr—Mo plating containing 0.55% of Mo;
E-2 is an example of the invention having a Cr—Mo plating containing 0.70% of Mo;
E-3 is an example of the invention having a Cr—Mo plating containing 0.80% of Mo;
E-4 is an example of the invention having a Cr—Mo plating containing 0.90% of Mo;
B is an evaluation of plating surface smoothness in microns;
C is an evaluation of workability of the plating layer wherein;
C-1 is the amount of wear of honing grinder in microns;
C-2 is an evaluation of easiness of machining;
D is the result of the engine run test wherein;
D-1 is the observation of chatter marks, higher values showing better results;
D-2 is the observation of scratches on the rotor housing, higher values showing better results;
D-3 is wear of the apex seal in microns;
D-4 is observation of the nature of wear;
D-5 is observation of existence of seizure of the apex seal to the rotor housing, YES denoting existence of seizure;
D-6 is lubricant oil consumption in l/hr;
E is the overall evaluation of the plating layer.

TABLE II

| C | Si | Mn | P | S | Cr | Cu | Mo | Ni | Mg | V | Fe |
|---|---|---|---|---|---|---|---|---|---|---|---|
| 3.5 | 2.3 | 0.4 | 0.2 | 0.02 | 0.5 | 1.0 | 1.5 | 1.0 | 0.01 | 0.2 | bal. |

Referring to Table I, it will be noted that the examples of the present invention show preferable properties over the test piece having a conventional Cr plating and the test piece having a Cr-Mo plating of a smaller Mo content in respect of chatter marks, scratches, amount and evenness of wear and occurance of seizures. In evaluating the chatter marks and scratches, the defects are classified into six grades and the most serious defects are classified into the grade 0 whereas no defect is classified into the grade 5.

In FIG. 3, it will be noted the specimens S-1 and S-2 which have no or less Mo content show significant decrease in the compression after 5000 cycles of operation, however, in the specimens prepared in accordance with the present invention, no such tendency is found. It should further be noted that the addition of Mo has an effect of improving durability to acids as well known in the art.

Various properties have been investigated from the test results and the results of the evaluations are as follows:

(1) HEAT RESISTANT PROPERTY

Figure 4:
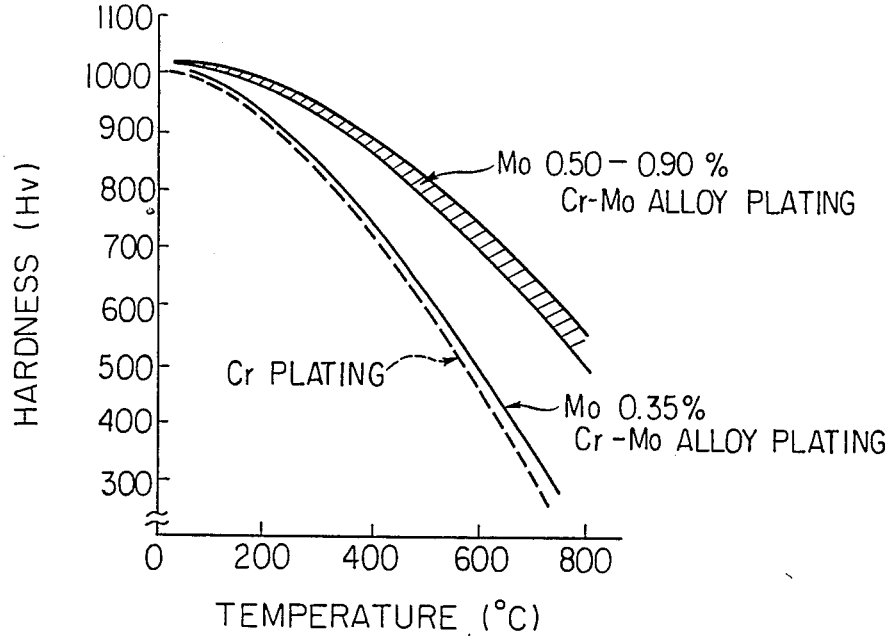
FIG. 4 is a diagram showing changes in the hardness of the plating layer in response to changes in temperature.

In FIG. 4, there are shown changes in hardness under an elevated temperature. In FIG. 4, it will be noted that the Cr-Mo plating shows less decrease in hardness under an elevated temperature as compared with the Cr plating. This fact will show that the Cr-Mo plating is more suitable than Cr plating for sliding surface of a high power engine wherein a superior heat resistant property is required. Where the Mo content is less than 0.5%, such improvement in hardness cannot be expected.

Figure 5:
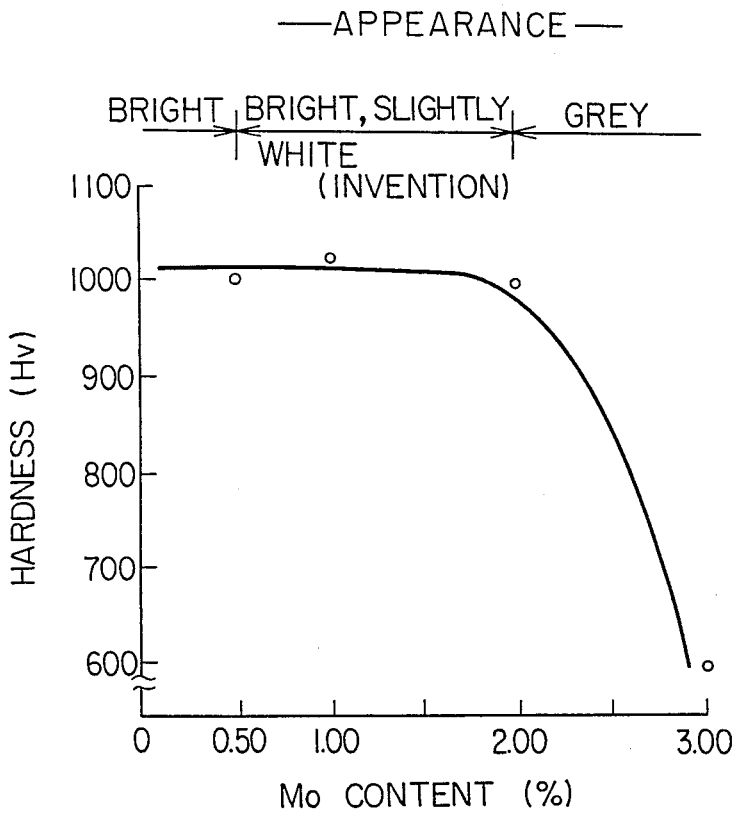
FIG. 5 is a diagram showing effects of Mo content on the hardness and appearance of the plating layer.

FIG. 5 shows the effect of the Mo content in the Cr-Mo plating on the hardness and the appearance of the plating layer. With the Mo content greater than 2%, the plating layer shows a grayish appearance and the hardness decreases remarkably.

(2) AFFINITY TO OIL

Figure 6:
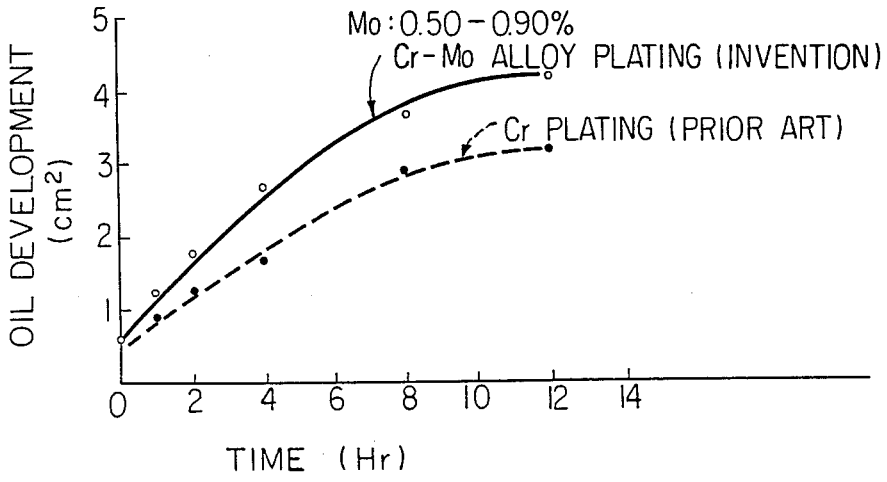
FIG. 6 is a diagram showing effects of Mo content on the intimacy to oil of the plating layer.

In FIG. 6, there is shown a comparison of the Cr-Mo plating with the Cr plating in respect of the development of oil on the plating layer. The tests have been carried out by dropping a droplet of commercially available lubricant oil on a specimen having either a Cr plating or a Cr-Mo plating of 50 microns thick which has been finished by means of a honing grinder of #1000 grade. Observation has then been made of development of the oil droplet by measuring the area of the oil on the plating surface. In FIG. 6, it will be noted that the Cr-Mo plating is preferable over the Cr plating in respect of the affinity to oil. Therefore, the Cr-Mo plating is more suitable than the Cr plating as the engine sliding surface where a lubricating property is recommended.

(3) FRICTION COEFFICIENT

In Table III, there is shown the dynamic friction coefficient of the Cr-Mo plating with respect to the chilled alloy cast iron which is used for the apex seal. For the purpose of comparison, the dynamic friction coefficient of the Cr plating is also shown.

TABLE III

| | |
|---|---|
| Cr plating | 0.45 to 0.58 |
| Cr—Mo plating | 0.25 to 0.30 |

It will be noted in Table III that the dynamic friction coefficient of the Cr-Mo plating is lower than that of the Cr plating.

(4) MACHINING OF THE PLATING LAYER

Figure 7:
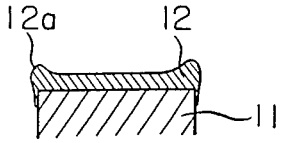
FIG. 7 is a sectional view of a rotor housing immediately after the plating is performed.

Referring to Table I, it will be noted that the Mo content in the plating layer has an adverse effect on the uniformity of deposition of the plating alloy. In fact, as the Mo content increases, the plating layer becomes less uniform and the workability by honing becomes worse. This is understood as being caused by the fact that there is produced in the plating layer at a corner portion a projection 12a as shown in FIG. 7 and the projection 12a causes an increased wear of the honing grinder. In Table I, the height of the projection 12a is represented by the surface smoothness in microns. This tendency becomes significant as the Mo content increases beyond 0.90%. Therefore, the Mo content shall not be greater than 0.90%.

(5) OIL CONSUMPTION AND PORE CONFIGURATION

Figure 8:
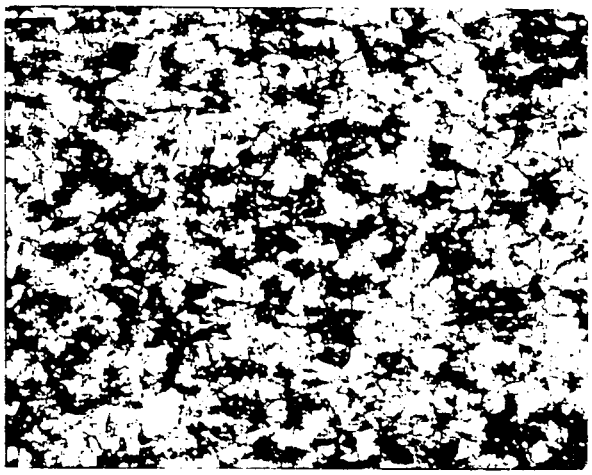
FIG. 8 is a microscopic picture showing the structure of the plating layer in accordance with one embodiment of the present invention; and, FIG. 9 is a microscopic picture showing the Cr-Mo plating containing 1.15% of Mo.
Figure 9:
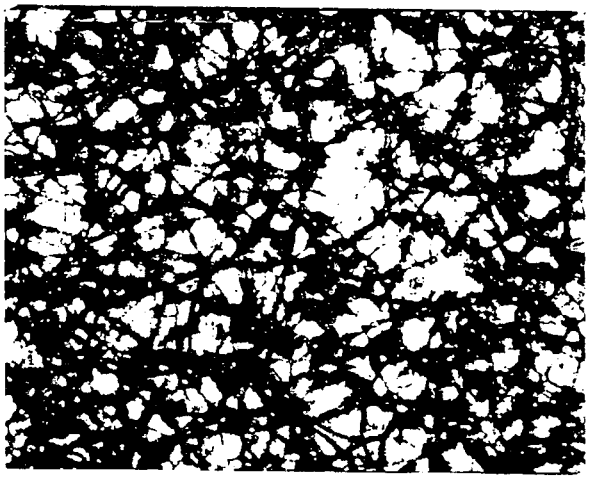

The test results in Table I further show that the Mo content greater than 0.50 is effective to improve the resistance to the chatter marks and scratches and to decrease the wear of the apex seal. Such tendencies are seen as far as the Mo content increases up to 2.00%. It is understood that the reasons for the tendencies are that there are differences in the porosities on the plating surfaces depending on the Mo content in the plating layer. In FIG. 8, there is shown a microscopic picture magnified 200 times of the Cr-Mo plating containing 0.80% of Mo. Further, in FIG. 9, there is shown a microscopic picture magnified 200 times of the Cr-Mo plating containing 1.15% of Mo. It will be understood that as the Mo content increases, the sizes of the channel-shaped cracks produced by the reverse current electrolytic treatment are increased. Where the pores on the plating layer are excessively large, there will be a tendency that a channel-shaped pore is subjected to a high combustion pressure at one end portion and to a low pressure at the other end portion when the apex seal slides on the pore, so that lubricant oil in the pore is drawn under the pressure difference into a working chamber wherein the suction pressure prevails. Thus, oil consumption is increased as the Mo content in the plating layer increases. By maintaining the Mo content below 0.90%, it is possible to suppress the oil consumption to a reasonably low level.

From the above, it will be understood that the Cr-Mo plating is very advantageous over the Cr plating for use in the inner wall surface of a rotor housing for a high power rotary engine in respect of heat resistance, affinity to lubricant oil and friction coefficient. It should further be noted that the Mo content of 0.50 to 0.90% is important in obtaining a low oil consumption.

The invention has thus been shown and described with reference to specific structures and specific examples, however, it should be noted that the invention is in no way limited to the applications as described but changes and modifications may be made without departing from the scope of the appended claims.

We claim:

1. A rotor housing for a rotary piston engine, including an inner wall surface of trochoidal configuration provided with a porous plating layer of a Cr-Mo alloy containing 0.50 to 0.90% in weight of Mo.

2. A rotor housing in accordance with claim 1 in which said plating layer has a composite porous structure including pin-point type pores and channel type pores.

3. A rotor housing in accordance with claim 1 in which said plating layer has a porous structure including pin-point type pores.

4. A rotor housing in accordance with claim 1 in which said plating layer has a porous structure including channel type pores.

5. A rotor housing for a rotary piston engine including a liner made of a steel material and having an inner wall of a trochoidal configuration, a housing body made of an aluminum alloy cast around the liner, said liner being formed at the inner wall with a Cr-Mo plating layer containing 0.50 to 0.90% in weight of Mo.

* * * * *